United States Patent [19]

Rohr

[11] Patent Number: 4,827,856

[45] Date of Patent: May 9, 1989

[54] ALIGNMENT DEVICE FOR A SEWING MACHINE

[75] Inventor: Gunter Rohr, Hemmingen, Fed. Rep. of Germany

[73] Assignee: Union Special GmbH, Stuttgart, Fed. Rep. of Germany

[21] Appl. No.: 80,734

[22] Filed: Aug. 3, 1987

[30] Foreign Application Priority Data

Aug. 22, 1986 [DE] Fed. Rep. of Germany ..... 3628624

[51] Int. Cl.[4] ..... D05B 27/12

[52] U.S. Cl. ..... 112/63; 112/306; 112/322

[58] Field of Search ..... 112/306, 308, 312, 313, 112/322, 63; 384/535, 536

[56] References Cited

U.S. PATENT DOCUMENTS

| | | | |
|---|---|---|---|
| 2,766,709 | 10/1956 | Stevens, Jr. | 112/63 |
| 3,015,932 | 1/1962 | McCard | 384/536 X |
| 3,472,188 | 10/1969 | Hayes | 112/323 |
| 3,631,954 | 1/1972 | Coaley | 384/536 X |
| 3,693,561 | 9/1972 | Hainko, Jr. et al. | 112/308 X |
| 4,191,118 | 3/1980 | Blessing | 112/308 X |
| 4,295,435 | 10/1981 | Vemura et al. | 112/322 |
| 4,296,700 | 10/1981 | Jehle et al. | 112/308 X |
| 4,423,690 | 1/1984 | Willenbacher et al. | 112/308 X |
| 4,467,734 | 8/1984 | Rohr | 112/63 |
| 4,479,447 | 10/1984 | Rohr | 112/63 X |
| 4,530,294 | 7/1985 | Pollmeier et al. | 112/63 |

FOREIGN PATENT DOCUMENTS

| | | | |
|---|---|---|---|
| 78479 | 7/1955 | Netherlands | 384/535 |

*Primary Examiner*—Wm. Carter Reynolds
*Attorney, Agent, or Firm*—Emrich & Dithmar

[57] ABSTRACT

An alignment device for the automatic adjustment of the edge of a tubular workpiece to be sewn on a sewing machine having, a presser foot, a feed dog operating on the presser foot, a sensing device for detecting the edge of the workpiece, and a guide member disposed on a side of the feed dog. The alignment device has a device for rotatably driving the guide member, and a device responsive to the sensing device for controlling the equatorial or peripheral speed of the guide member relative to the sewing speed of the sewing machine.

7 Claims, 3 Drawing Sheets

ALIGNMENT DEVICE FOR A SEWING MACHINE

BACKGROUND OF THE INVENTION

The invention relates to an alignment device for the automatic alignment of the edge of a tubular workpiece to be sewn on a sewing machine.

An alignment device is described, for example, in British Patent Specification No. 2064601A corresponding to U.S. Pat. No. 4,467,734. This device requires at least two drivable tensioning parts for receiving and aligning tubular workpieces, rotating alignment members being disposed on at least one of the tensioning parts. However it is desirable to simplify such a device and to improve the alignment function in order to accelerate automatic alignment of the workpiece edge.

SUMMARY OF THE INVENTION

A principle feature of the present invention is the provision of an improved alignment device for the automatic alignment of the edge of a tubular workpiece to be sewn on a sewing machine.

The alignment device of the present invention comprises, a presser foot, a feed dog operating on the presser foot, and a sensing device for detecting the edge of the workpiece. The alignment device has a guide member disposed on a side of the feed dog, and means for rotatably driving the guide member.

A feature of the present invention is the provision of means responsive to the sensing device for controlling the equatorial or peripheral speed of the guide member relative to the sewing speed of the sewing machine.

Another feature of the invention is that precise alignment of the workpiece edge together with uniform spacing with respect to the needle of the sewing machine are achieved by altering the equatorial or circumferential speed of the guide body relative to the sewing speed according to instantaneous course of the workpiece edge.

A further feature of the invention is that the higher the equatorial or peripheral speed of the guide member relative to the sewing speed, the smaller becomes the gap between the workpiece edge, which has not yet been sewn, and the needle transversely with respect to the sewing direction.

Another feature of the invention is that the lower the equatorial or peripheral speed of the guide member relative to the sewing speed, the larger becomes the gap between the workpiece edge and the needle, since, given a varying equatorial or peripheral speed of the guide member compared with the workpiece speed, a clockwise or anti-clockwise torque is exerted on the workpiece, which has not yet been sewn, in the region of the feed dog due to lateral positioning of the guide member with respect to the feed dog.

Further features will become more fully apparent in the following description of the embodiments of this invention and from the appended claims.

DESCRIPTION OF THE PREFERRED EMBODIMENTS

Figure 1:
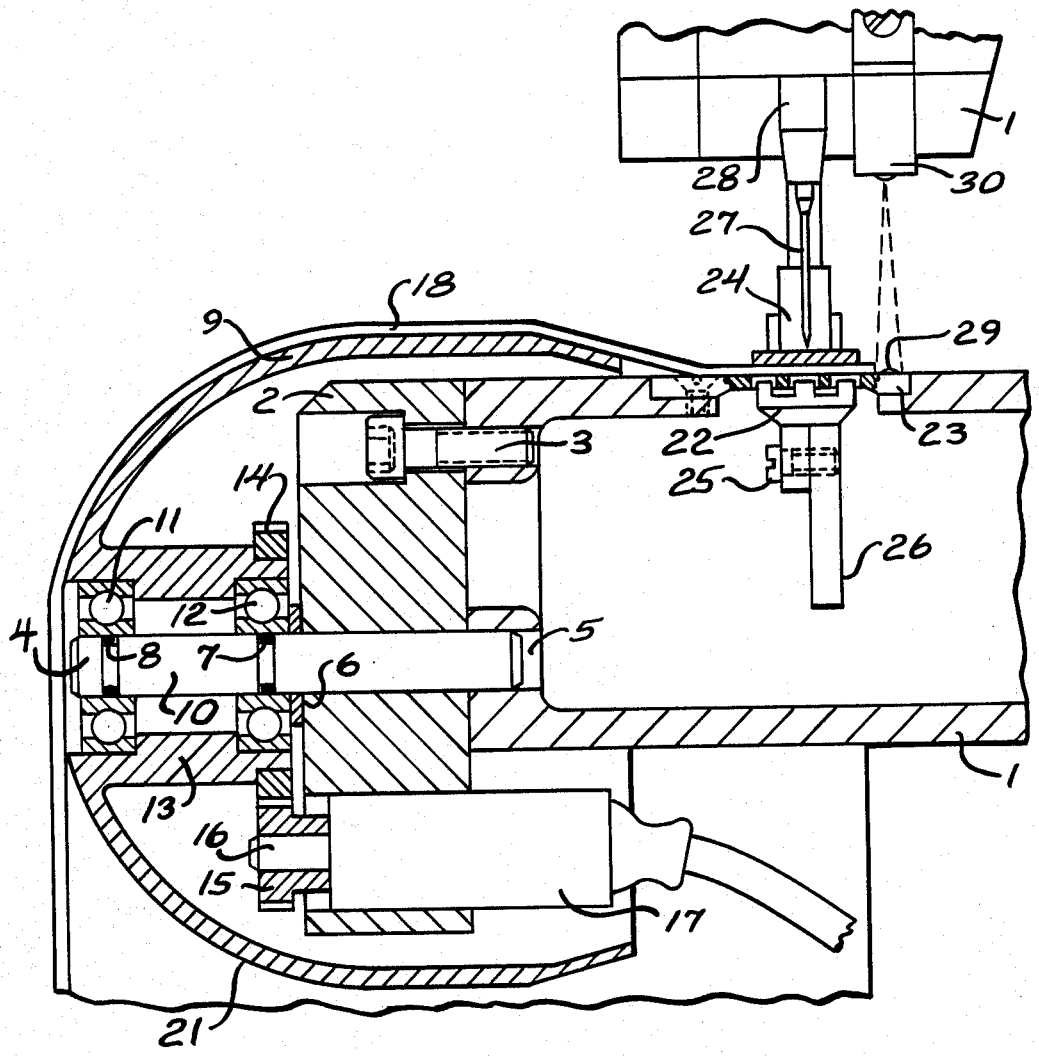
FIG. 1 is a sectional view of an alignment device of the invention showing part of a sewing machine from the front.
Figure 2:
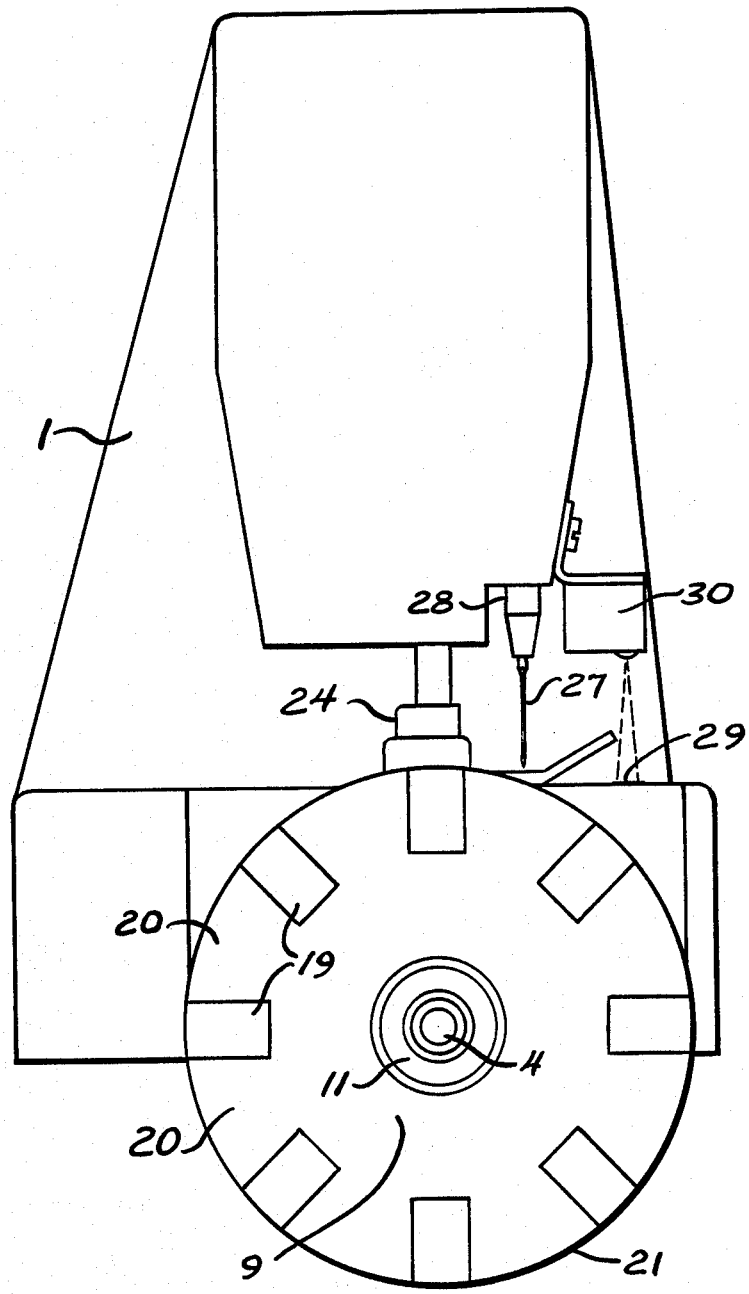
FIG. 2 is a side elevational view of the sewing machine showing the alignment device on a reduced scale.

Referring now to FIGS. 1 and 2, a holder 2 is fastened by a screw 3 to a sewing machine housing 1. One end of a shaft 4, which is pressed into the holder 2, projects into a housing bore 5 to act as a dowel and its other end carries a spacer ring 6 and elastic rings 7 and 8. The axis of the housing bore 5 is the axis of rotation 10 of a guide member 9.

The guide member 9 contains ball bearings 11 and 12. The ball bearings 11, 12 are in clamping contact with the elastic rings 7 and 8. As a result, the guide member 9 can be simply removed from the shaft 4 during maintenance work, or, when changing over production, it can be replaced by another guide member. A gear rim 14 is pressed onto a internal hub 13 in the guide member 9 and meshes with a pinion 15 which is secured to a shaft 16 of a variable-speed motor 17.

The variable-speed motor 17 is electrically connected to a sensing device 30 for detecting the workpiece edge and its speed can be controlled by changing the voltage.

Figure 3:
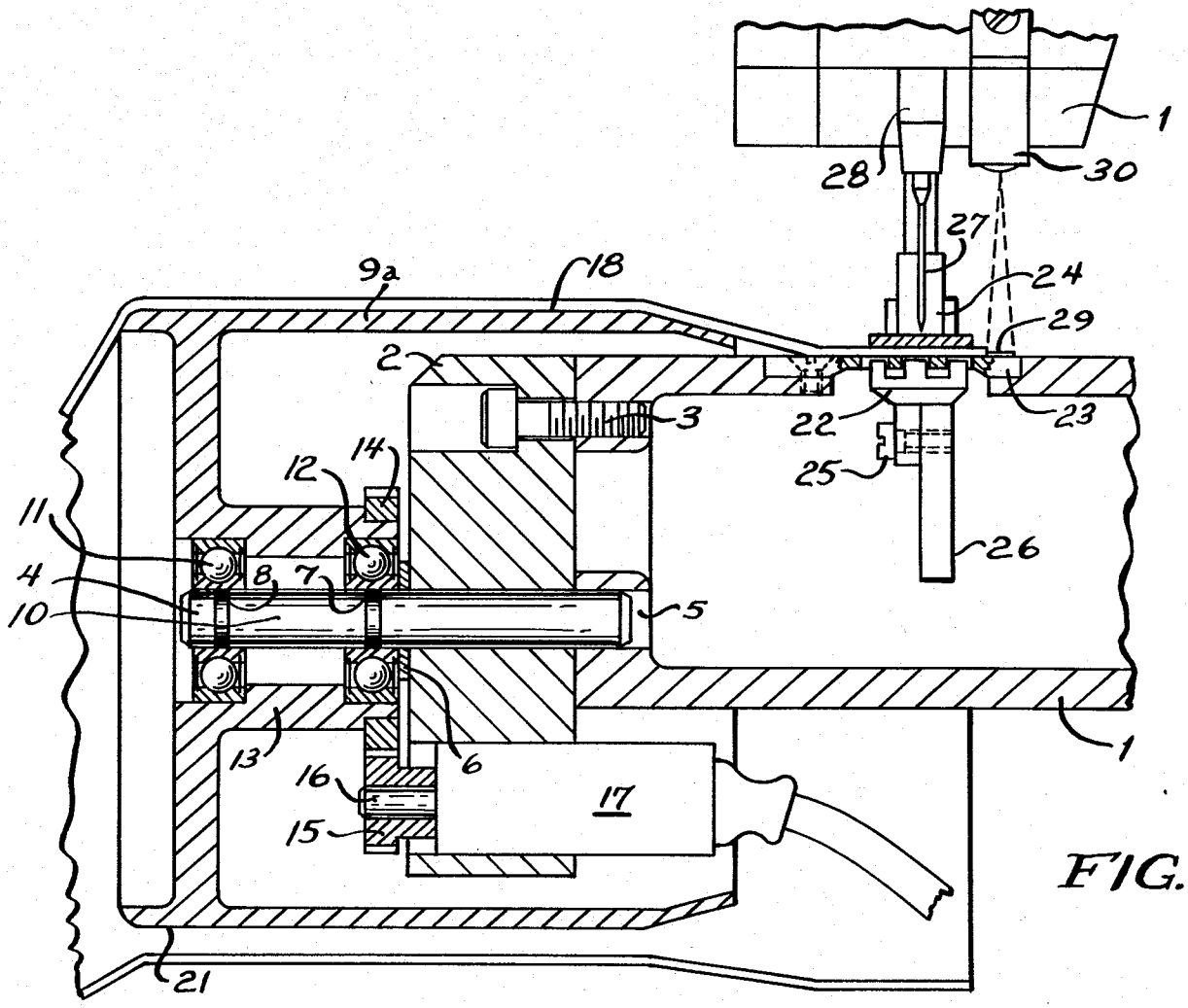
FIG. 3 is a sectional view of another embodiment of a guide member of the alignment device.

A tubular workpiece part 18 to be sewn adheres to zones 19 and 20 of varying coefficients of friction on the surface 21 of the guide member 9 and is transported susbtantially parallel to the feed direction of feed dogs 22. The guide member 9, which is shown in the drawings as being predominantly convex, can be in a different embodiment and predominantly cylindrical, as shown in FIG. 3 such as the guide member 9*a* shown in FIG. 3. The optimum form of the guide member 9 is determined by the workpiece part 18 to be sewn. The workpiece part 18 is actually fed between a needle plate 23 and a presser foot 24 by means of the feed dogs 22, which are fastened by a screw 25 to a feed dog carrier 26. The feed dog carrier 26 is moved conventionally by a transmission, and acts together with a needle 27 on the workpiece 18. The needle 27 is secured in a needle bar 28, which is displaceably mounted in the sewing machine housing 1.

Should the edge sensing device sense that the lateral distance between the needle 27 and the edge of the workpiece is becoming too long, the speed of the motor 17 is increased so that the peripheral speed of the guide member 9 becomes larger than the sewing speed as produced by the feed dogs 22. Consequently a clockwise torque (as seen in plan) is exerted on the workpiece, causing the seam being sewn to come closer to the workpiece edge. Conversely, if the distance between the needle 27 and the edge of the workpiece become too small, the motor speed is adjusted so that the peripheral speed of the guide member 9 is made less than the sewing speed.

The foregoing detailed description is given for clearness of understanding only, and no unnecessary limitations should be understood therefrom, as modifications will be obvious to those skilled in the art.

What is claimed is:

1. An alignment device for the automatic alignment of the edge of a tubular workpiece to be sewn on a sewing machine, having at least one feed dog operating against a presser foot, comprising a sensing device for detecting the edge of the workpiece and only one rotatably driven workpiece guide member which is disposed to the side of the feed dog and whose equatorial or peripheral speed relative to the sewing speed is controlled by the sensing device, in which the guide member acts laterally on the side of the workpiece facing the feed dog and is secured at its axis of rotation to the sewing machine housing.

2. An alignment device as claimed in claim 1, in which the guide member has zones having different coefficients of friction.

3. An alignment device as claimed in claim 1, in which the guide member is defined as a predominantly convex body of rotation.

4. An alignment device as claimed in claim 1, in which the guide member is defined as a predominantly cylindrical body of rotation.

5. An alignment device as claimed in claim 1 in which the guide member is clamped onto a shaft by means of elastic rings.

6. An alignment device of claim 1 in which the guide member is drivingly connected to a variablespeed motor.

7. An alignment device for the automatic alignment of the edge of a tubular workpiece to be sewn on a sewing machine, comprising:

a presser foot;

a feed dog operating on the presser foot;

a sensing device for detecting the edge of the workpiece;

a guide member disposed on a side of the feed dog;

means for rotatably driving the guide member; and means responsive to the sensing device for controlling the equatorial or peripheral speed of the guide member relative to the sewing speed of the sewing machine, wherein the guide member acts on a side of the workpiece facing the feed dog and causes lateral alignment of the workpiece solely by the equatorial speed of the guide member, and including means for securing the guide member about its axis of rotation to a housing of the sewing machine.

* * * * *